US011319621B2

(12) United States Patent
Kawano

(10) Patent No.: US 11,319,621 B2
(45) Date of Patent: May 3, 2022

(54) STEEL FOR MOLD, AND MOLD

(71) Applicant: DAIDO STEEL CO., LTD., Nagoya (JP)

(72) Inventor: Masamichi Kawano, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 45 days.

(21) Appl. No.: 16/369,369

(22) Filed: Mar. 29, 2019

(65) Prior Publication Data

US 2019/0300991 A1 Oct. 3, 2019

(30) Foreign Application Priority Data

Apr. 2, 2018 (JP) ..... JP2018-071149

(51) Int. Cl.
*C22C 38/24* (2006.01)
*C22C 38/00* (2006.01)
(Continued)

(52) U.S. Cl.
CPC ..... *C22C 38/24* (2013.01); *C21D 6/002* (2013.01); *C21D 8/005* (2013.01); *C21D 9/0068* (2013.01); *C22C 38/001* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/30* (2013.01); *C22C 38/40* (2013.01); *B22D 17/2209* (2013.01); *C21D 1/32* (2013.01)

(58) Field of Classification Search
CPC ..... C22C 38/24; C22C 38/001; C22C 38/02; C22C 38/04; C22C 38/06; C22C 38/20; C22C 38/22; C22C 38/26; C22C 38/30; C22C 38/40; C22C 38/44; C22C 38/46; C22C 38/18; C21D 6/002; C21D 9/0068; C21D 8/005; C21D 1/32; B22D 17/2209
See application file for complete search history.

(56) References Cited

U.S. PATENT DOCUMENTS 4,853,181 A 8/1989 Wert et al.
6,365,096 B1 * 4/2002 Sandberg ..... C22C 38/24 420/111

(Continued)

FOREIGN PATENT DOCUMENTS

CN 1295624 A 5/2001
CN 101316943 A 12/2008

(Continued)

OTHER PUBLICATIONS

WO 2019077171 A1—Espacenet English machine translation (Year: 2019).*

(Continued)

*Primary Examiner* — Alexandra M Moore
*Assistant Examiner* — Adil A. Siddiqui
(74) *Attorney, Agent, or Firm* — McGinn I.P. Law Group, PLLC.

(57) ABSTRACT

The present invention relates to a steel for a mold, which has a composition containing, on % by mass basis: 0.35%≤C≤0.40%, 0.003%≤Si≤0.20%, 0.72%≤Mn≤0.94%, 5.65%≤Cr≤6.00%, 1.65%≤Mo≤2.00%, 0.71%≤V≤0.90%, and 0.001%≤N≤0.080%, with the balance being Fe and inevitable impurities.

25 Claims, 8 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/26*** | (2006.01) |
| ***C22C 38/30*** | (2006.01) |
| ***C22C 38/40*** | (2006.01) |
| ***C21D 6/00*** | (2006.01) |
| ***C21D 9/00*** | (2006.01) |
| ***C21D 8/00*** | (2006.01) |
| ***B22D 17/22*** | (2006.01) |
| ***C21D 1/32*** | (2006.01) |

(56) References Cited

U.S. PATENT DOCUMENTS

| | | | | |
|---|---|---|---|---|
| 2008/0302501 | A1 | 12/2008 | Binot et al. | |
| 2015/0314366 | A1* | 11/2015 | Kawano | B22F 5/007 249/117 |
| 2018/0229294 | A1 | 8/2018 | Kawano | |
| 2018/0282832 | A1 | 10/2018 | Kawano et al. | |

FOREIGN PATENT DOCUMENTS

| | | | | | |
|---|---|---|---|---|---|
| CN | 101368247 | A | | 2/2009 | |
| CN | 101921958 | A | | 12/2010 | |
| CN | 101921959 | A | | 12/2010 | |
| CN | 102000954 | A | | 4/2011 | |
| CN | 105420630 | A | | 3/2016 | |
| EP | 2 218 802 | A1 | | 8/2010 | |
| EP | 2 270 245 | A1 | | 1/2011 | |
| EP | 2 270 246 | A1 | | 1/2011 | |
| EP | 3 382 053 | A1 | | 10/2018 | |
| JP | S 62-161942 | A | | 7/1987 | |
| JP | H 06-322483 | A | | 11/1994 | |
| JP | 2003-268486 | A | | 9/2003 | |
| JP | 2008-308745 | A | | 12/2008 | |
| JP | 2011-001572 | A | | 1/2011 | |
| JP | 2013087322 | A | * | 5/2013 | |
| JP | 2015-193867 | A | | 11/2015 | |
| JP | 2016-017200 | A | | 2/2016 | |
| KR | 2010-0135205 | A | | 12/2010 | |
| KR | 2018-0109763 | A | | 10/2018 | |
| WO | WO 2017/038879 | A1 | | 3/2017 | |
| WO | WO 2017/043446 | A1 | | 3/2017 | |
| WO | WO-2018182480 | A1 | * | 10/2018 | C22C 38/22 |
| WO | WO-2019077171 | A1 | * | 4/2019 | B23K 26/342 |

OTHER PUBLICATIONS

JP-2013087322-A: Espacenet English machine translation (Year: 2013).*

Taiwanese Office Action, dated Sep. 27, 2019, in Taiwanese Application No. 108111721 and English Translation thereof.

Extended European Search Report dated Jul. 3, 2019 for European Patent Application No. 19166835.9-1103.

AUTORENKOLLEKTIV: "Spurenelemente im Stahl-Moeglichkeiten zur Beeinflussung im Schmelzbetrieb", Spurenelemente in Staehlen, Verlag Stahleisen, Duesseldorf, DE,Jan. 1, 1985 (Jan. 1, 1985), pp. 19-22.

European Office Action, dated Jul. 27, 2020, in European Application No. 19 166 835.9-1103.

Korean Office Action, dated Sep. 3, 2020, in Korean Application No. 10-2019-0036992 and English Translation thereof.

Chinese Office Action, dated Sep. 18, 2020, in Chinese Application No. 201910261197.7 and English Translation thereof.

Chinese Office Action, dated Mar. 30, 2021, in Chinese Application No. 201910261197.7 and English Translation thereof.

Chinese Office Action, dated Jul. 5, 2021, in Chinese Patent Application No. 201910261197.7 and English Translation thereof.

Japanese Office Action, dated Feb. 1, 2022, in Japanese Patent Application No. 2018-071149 an English Translation thereof.

* cited by examiner

STEEL FOR MOLD, AND MOLD

FIELD OF THE INVENTION

The present invention relates to a steel for a mold that is suitably applied as a mold in die-casting, injection molding for plastics and rubber, forging, or the like, and relates to the mold.

BACKGROUND ART OF THE INVENTION

A hot-working die steel represented by JIS SKD61 has been used as a material of a die-casting mold used for manufacturing a die-casting product. However, conventional hot-working die steels could not sufficiently satisfy various properties required for a material of the die-casting mold.

For example, the die-casting mold (including components constituting a part of the mold) is manufactured through the steps of: melting, refining, casting, homogenization heat treatment, hot-working, normalizing, annealing, crude machining (rough processing), quenching and tempering, and finishing machining in this order.

In addition, surface modification (PVD, CVD, nitriding, shot peening, etc.) may be applied to the die-casting mold as necessary.

Here, materials used for the die-casting mold are required to have "(1) good annealing property". The annealing in the above-mentioned process for manufacturing a mold is used to soften the material to have a hardness that is easy for the subsequent "crude machining" The more the annealing is completed in a short time, the better the productivity is, which is preferable.

SKD61, which is a kind of 5Cr-based die steels and a representative steel of die-casting steels, is softened to about 85 to 94 HRB by simple annealing in which SKD61 is cooled from a temperature range of 870° C. to 900° C. to 645° C. at a rate of 15° C./h to 30° C./h. One of the excellent points of SKD61 is a good annealing property thereof.

It is difficult to sufficiently perform the crude machining before quenching in the case where the annealed material has a hardness of exceeding 97 HRB. Therefore, a steel grade showing a hardness of exceeding 97 HRB after annealing must be additionally heated for a long period of time at 600° C. to 750° C. after annealing, to thereby reduce its hardness. As a result, the productivity decreases, which causes delay in delivery time and increase in cost. Another 5Cr-based die steel, which contains more Mn, Ni, Cu, Mo, or the like as compared with SKD61, has a poor annealing property, which is an adverse effect of high hardenability. Accordingly, such a 5Cr-based die steel has a problem of decrease in productivity due to the long-time heating after annealing.

In addition, materials used for the die-casting mold are required to have "(2) a large crystal grain-size number during quenching (fine crystal grains)". This is for preventing crack growth when the material is used as a mold after quenching and tempering, to avoid a break of the mold. It is a grain boundary that has resistance to the crack growth. Therefore, the finer the crystal grains are (there are more grain boundaries in the same volume), the shorter the length of the crack under the same external is, and the more difficult the mold breaks. When crystal grains are held at a certain temperature, the crystal grains grow and become coarse (the crystal grain-size number decreases) as the crystal grains is held for a long time.

Another excellent point of SKD61 in addition to the good annealing property is that the crystal grain-size number during quenching is large (crystal grains are fine). The die-casting mold is held at 1030° C. for about 5 hours during quenching. However, even during such a long-time maintenance, austenite crystal grains of SKD61 has the grain size number of 7 or greater and the austenite crystal grains are fine. Another 5Cr-based die steel, which contains less C, Si and V as compared with SKD61, contains a small amount of carbides that prevent movement of the austenite crystal grain boundary during quenching. Accordingly, in such a 5Cr-based die steel, crystal grains tend to grow and grain size numbers decrease. In the case where the grain size numbers of austenite crystal grains during the quenching are less than 5, a crack tends to occur during usage when the material is used as a mold after quenching and tempering.

In addition, materials used for the die-casting mold are required to have "(3) a high impact value even with a low quenching rate". This is for preventing crack growth when the material is used as a mold after quenching and tempering, to avoid a break of the mold. A mold having an impact value at 25° C. (U notch radius: 1 mm, height under the notch: 8 mm, cross-sectional area under the notch: 0.8 $cm^2$) being 32 $J/cm^2$ or higher is difficult to break. In the quenching for a large mold (having a weight of 250 kg or heavier) from 1030° C., at a temperature region of 400° C. or lower, the quenching rate remarkably decreases to about 3° C./min inside the mold (the inside of the mold is quite difficult to be cooled due to mass effect). In the case where a steel material has a poor hardenability and the quenching rate is slow (so-called "slow-rate quenching"), a bainite transformation rather than a martensite transformation occurs at high temperatures, and the structure (lath, block or packet) in the crystal grain is coarsened. As a result, the crack tends to propagate along the coarse structure in the grain even though the austenite crystal grains during quenching are fine. Accordingly, such a steel material shows a small amount of energy absorbed. SKD61, which has poor hardenability, may causes bainite transformation at high temperatures in the case where the quenching rate is about 3° C./min at a temperature region of 400° C. or lower. Therefore, when SKD61 is tempered to have a hardness of 43HRC that is required to be used as a mold, it is difficult to achieve an impact value of exceeding 32 $J/cm^2$.

One of the disadvantages of SKD61 is poor hardenability thereof. Another 5Cr-based die steel, which contains more Mn as compared with SKD61, has high hardenability. Therefore, such a 5Cr-based die steel can give a high impact value even with a low quenching rate.

Furthermore, in order to shorten the cycle time, improve the quality of the cast product, reduce thermal fatigue cracking, and reduce soldering, materials used for the die-casting mold are required to have "(4) high thermal conductivity". The mold having high thermal conductivity not only has good cooling efficiency but also undergoes small thermal shock. As a result, such a mold can achieve advantages of a shortened cycle time, increased quality of the die-casting product, and reduced mold damage.

The SKD61 after being tempered to have a hardness of 43 HRC has a thermal conductivity (measured by a laser flash method) at 25° C. of 23.0 W/m/K to 24.5 W/m/K, which is low and not desirable as a die-casting mold. Another disadvantage of SKD61 in addition to the poor hardenability is low thermal conductivity thereof. Another 5Cr-based die steel, which contains less Si as compared with SKD61, shows higher thermal conductivity than that of SKD61.

Table 1 below shows the properties of the conventional 5Cr-based die steels described above by A, B and C. As shown in Table 1, none of the conventional die steels satisfies all the followings: (1) good annealing property; (2) large crystal grain-size number during quenching; (3) high impact value even with a low quenching rate; and (4) high thermal conductivity.

Although the problems have been described by reference to the case where the steel for a mold is used for a die-casting mold, these problems can be also raised in cases where the steel for a mold is used for a mold in other fields such as an injection molding mold for plastics.

TABLE 1

| | SKD61 1Si—0.4Mn—1.2Mo | Modified steel A 0.5Si—0.6Mn—2.8Mo | Modified steel B 0.3Si—1.1Mn—2.5Mo | Modified steel C 0.1Si—0.6Mn—3Mo |
|---|---|---|---|---|
| (1) Annealing Property | A | B | C | A |
| (2) Crystal Grain Size | A | B | B | A |
| (3) Impact Value | C | B | A | C |
| (4) Thermal Conductivity | C | B | B | A |

Patent Document 1 below discloses a hot-working tool steel having improved thermal conductivity and impact value as compared with SKD61. However, the hot-working tool steel described in Patent Document 1 has an additive amount of V being lower than 0.7%, which is low and different from the present invention.

In addition, Patent Document 1 does not disclose any example in which combination of the elements C, Mn, Cr, and Mo satisfies the component ranges of the steel according to the present invention. Although the steel of the present invention requires the C content to be 0.35%≤C≤0.40%, only Examples that satisfy the requirement of the C content, among Examples of Patent Document 1, are an invention steel A11 and a comparative steel A10. The invention steel A11 of Patent Document 1 contains Mn, Mo, and V, which contents are respectively out of the component ranges of the steel according to the present invention. The comparative steel A10 of Patent Document 1 contains Si, Mn, Cr, Mo, and V, which contents are respectively out of the component ranges of the steel according to the present invention.

Patent Document 2 below discloses a hot-forging steel having more excellent hardenability and creep properties as compared with SKD61. The hot-forging steel described in Patent Document 2 is similar to the steel according to the present invention in the idea of enhancing the hardenability. However, Patent Document 2 does not consider the annealing property, and does not disclose any example in which the component ranges of Mn and Cr of the steel according to the present invention is satisfied. In addition, the hot-forging steel described in Patent Document 2 is not intended to have high thermal conductivity. Accordingly, the Si content of Example 1 of Patent Document 2 is as high as 0.20% (equal to the upper limit in the present invention), and the Si content of Example 2 of Patent Document 2 exceeds the upper limit in the present invention.

Patent Document 3 below discloses a tool steel for hot-working, which has improved hardenability as compared with SKD61. However, Patent Document 3 does not refer to the annealing property and the thermal conductivity, and does not disclose any example that satisfies the component ranges of the steel according to the present invention. In Example of Patent Document 3, at least four elements among the six elements of C, Si, Mn, Cr, Mo, and V are out of the component ranges of the steel of the present invention.

In addition, the tool steel for hot-working, described in Patent Document 3 is also different from the steel of the present invention in that Ni is an essential element that is added with 0.5% or higher.

Patent Document 1: JP-A 2011-1572
Patent Document 2: JP-A H06-322483
Patent Document 3: JP-A S62-161942

SUMMARY OF THE INVENTION

An object of the present invention, under the circumstances described above, is to provide a steel for mold and a mold, which has a good annealing property, enables generation of fine austenite crystal grains even in a long-time heating in quenching, enables exhibition of a high impact value even in slow-quenching, and has high thermal conductivity.

The present invention provides a steel for a mold, which has a composition consisting of, on % by mass basis:

essentially,
0.35%≤C≤0.40%,
0.003%≤Si≤0.20%,
0.72%≤Mn≤0.94%,
5.65%≤Cr≤6.00%,
1.65%≤Mo≤2.00%,
0.71%≤V≤0.90%, and
0.001%≤N≤0.080%, and
optionally,
W≤5.00%,
Co≤4.00%,
Cu≤1.50%,
Ni≤1.50%,
B≤0.0050%,
Nb≤0.100%,
Ta≤0.100%,
Ti≤0.100%,
Zr≤0.100%,
Al≤1.00%,
S≤0.0500%,
Ca≤0.2000%,
Se≤0.50%,
Te≤0.100%,
Bi≤0.50%, and
Pb≤0.50%,
with the balance being Fe and inevitable impurities.

In the steel for a mold, the components shown below may be contained as inevitable impurities in the ranges as follows:

P≤0.050%,
S≤0.0080%,
Cu≤0.30%,
Ni≤0.30%,
Al≤0.10%,
W≤0.30%,
O≤0.01%,
Co≤0.30%,

Nb≤0.004%,
Ta≤0.004%,
Ti≤0.004%,
Zr≤0.004%,
B≤0.0001%,
Ca≤0.0005%,
Se≤0.03%,
Te≤0.005%,
Bi≤0.01%,
Pb≤0.03%,
Mg≤0.02%,
REM≤0.10%,
and the like.

The steel for a mold according to the present invention may contain, on % by mass basis, at least either of the following:

0.30%<W≤5.00%, and
0.30%<Co≤4.00%.

The steel for a mold according to the present invention may contain, on % by mass basis, at least either of the following:

0.30%<Cu≤1.50%, and
0.30%<Ni≤1.50%.

The steel for a mold according to the present invention may contain, on % by mass basis:

0.0001%<B≤0.0050%.

The steel for a mold according to the present invention may contain, on % by mass basis, at least one of the following:

0.004%<Nb≤0.100%,
0.004%<Ta≤0.100%,
0.004%<Ti≤0.100%, and
0.004%<Zr≤0.100%.

The steel for a mold according to the present invention may contain, on % by mass basis:

0.10%<Al≤1.00%.

The steel for a mold according to the present invention may contain, on % by mass basis, at least one of the following:

0.0080%<S≤0.0500%,
0.0005%<Ca≤0.2000%,
0.03%<Se≤0.50%,
0.005%<Te≤0.100%,
0.01%<Bi≤0.50%, and
0.03%<Pb≤0.50%.

Furthermore, the present invention provides a mold that is formed of the above-mentioned steel for a mold.

In the present invention, the "mold" includes not only a main body of the mold but also a mold component such as a pin, which is used by being assembled to the main body, or the like. Furthermore, a mold formed of the steel according to the present invention, which has been subjected to a surface treatment, is also encompassed.

In order to solve the above-mentioned problems, the present inventor has reexamined a relationship between the property of the 5Cr-based die steels represented by SKD61 and the components in detail. In addition to the four properties described above, machinability, fracture toughness values or the like were also sufficiently considered. As a result, he found that the above-mentioned problems can be solved in the case where contents of various elements are defined within the respective narrow ranges. In FIGS. 1A, 1B and 1C, the component ranges of the main elements in the steel for a mold according to the present invention are shown in comparison with SKD61 that is a representative of the 5Cr-based die steels.

DETAILED DESCRIPTION OF THE INVENTION

Figure 1A:
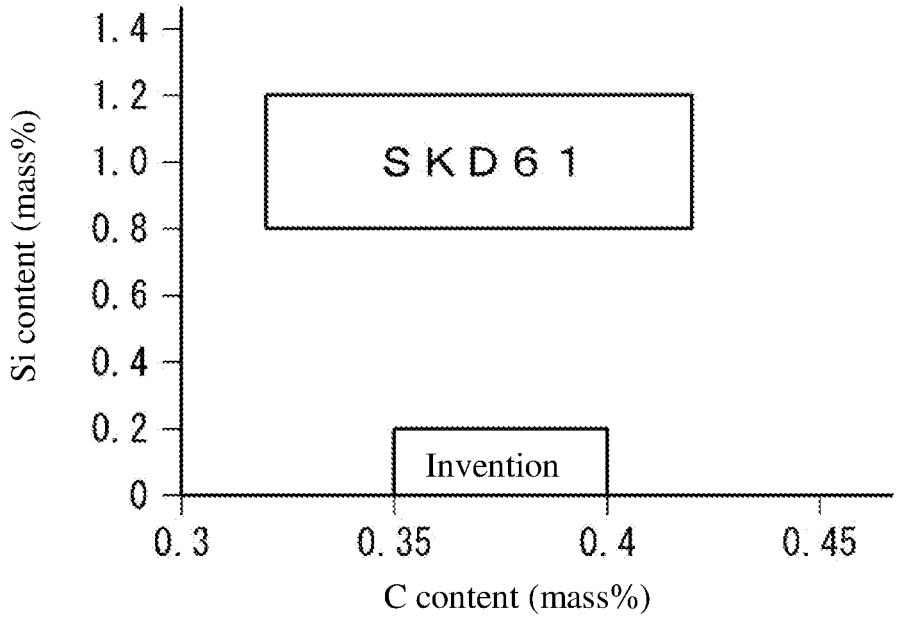
FIG. 1A is a graph showing a component range (C content and Si content) of a steel according to the present invention in comparison with SKD61.

FIG. 1A shows the contents of C and Si. As can be seen from FIG. 1A, in the steel according to the present invention, the content of Si is significantly smaller than that in SKD61. The "high thermal conductivity", which is one of the characteristics of the present invention, is achieved primarily due to the small content of Si.

Figure 1B:
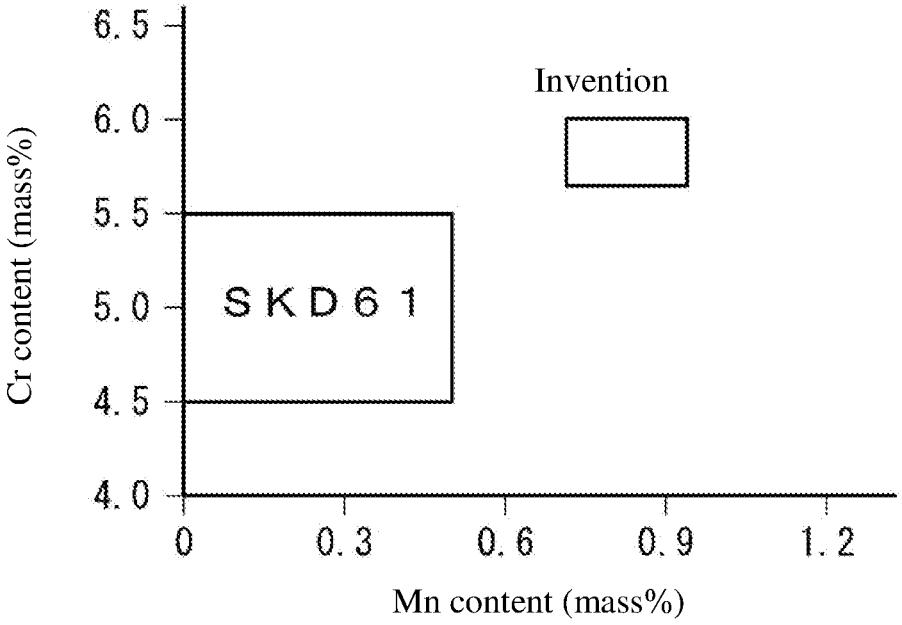
FIG. 1B is a graph showing a component range (Mn content and Cr content) of the steel according to the present invention in comparison with SKD61.

FIG. 1B shows the contents of Mn and Cr. As can be seen from FIG. 1B, in the steel according to the present invention, the contents of these two elements are larger than those in SKD61, in order to ensure high hardenability.

In general, the annealing property deteriorates as the hardenability improves. Usually, the content of Mn is increased in order to enhance the hardenability, but this alone makes the deterioration of the annealing property significant. The present inventor found that Cr, which enhances the hardenability similarly to Mn, has an effect opposite to Mn in terms of the annealing property (i.e., an effect of enhancing the annealing property). Accordingly, the contents of Mn and Cr are simultaneously increased in the steel according to the present invention. In order to achieve both the hardenability and the annealing property as described above, the balance between Mn and Cr is important. In addition, the annealing property is ensured also by optimizing the content of Mo or the like in the present invention as described below.

Figure 1C:
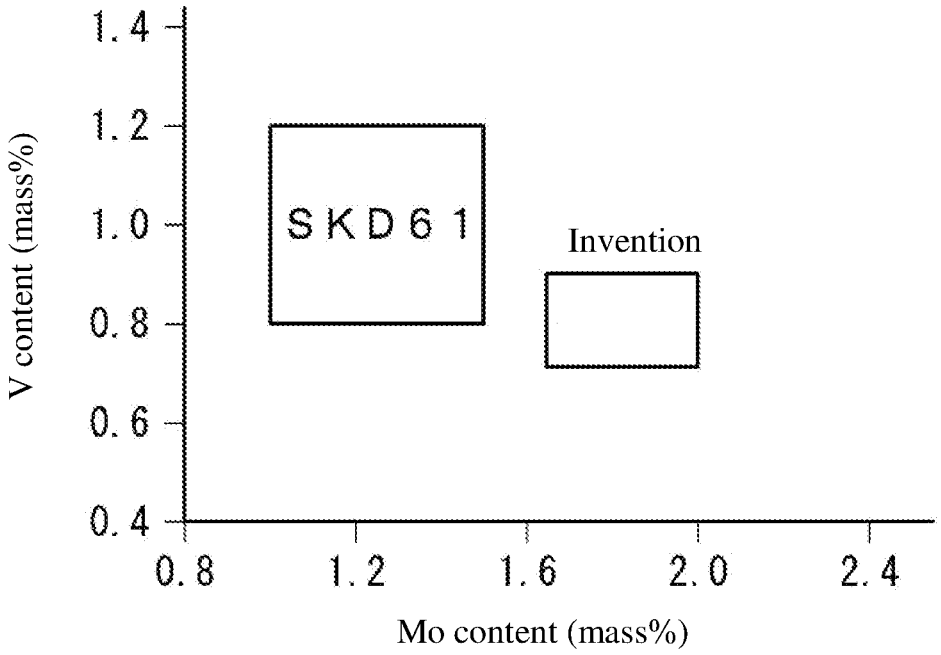
FIG. 1C is a graph showing a component range (Mo content and V content) of the steel according to the present invention in comparison with SKD61.

FIG. 1C shows the contents of Mo and V. As can be seen from FIG. 1C, in the steel according to the present invention, the content of Mo is larger than that in SKD61, and the content of V is smaller than that in SKD61. The steel according to the present invention ensures a secondary hardenability by reducing V that forms a coarse VC causing a large crack in a mold, and by adjusting the content of V+0.5Mo to be on a level with that in SKD61. In terms of the content of V, the range of the V content in the steel of the present invention has a region overlapping that of SKD61. However, it is most likely that the V content of the commercially available SKD61 is 1%, which is the median value of the standard. On the other hand, the V content in the steel according to the present invention is 0.9% or less. Therefore, the SKD61 and the steel of the present invention are substantially different in both the Mo content and the V content.

As described above, in the present invention, the above-mentioned four problems are solved by making the component ranges of the main elements significantly different from those of SKD61 which is a representative of hot-working die steels. Of course, basic properties as a die steel are not impaired either. In the present invention, it has been found that various properties can be combined at a high level as long as the contents of main elements are within the respective very narrow ranges as shown in FIGS. 1A, 1B and 1C.

The steel of the present invention described above is particularly suitable as a steel for die-casting mold. Alternatively, the steel of the present invention is also suitable as a steel for a mold in injection molding for plastics, a steel for a mold in rubber molding including injection molding, a steel for a mold in warm-forging, hot-forging or hot-stamping (also called hot-pressing or press-quenching), and the like.

JIS standards and ASTM standards referred to in the present description are based on the latest information (at Apr. 2, 2018).

Next, reasons for limiting the content of each chemical component in the steel of the present invention will be described below. The steel for a mold according to the present invention contains C, Si, Mn, Cr, Mo, V, N, and Fe as essential components. Among the chemical components described below, those other than the essential components are optional components. The value of the content of each chemical component is given on % by mass basis.

0.35%≤C≤0.40%

In the case of C<0.35%, it is difficult to stably obtain high hardness of 50 HRC or higher with a large Cr content, small Mo and V contents, and high tempering temperature.

In the case of 0.40%<C, the amount of coarse carbides increases, which provide starting points of cracking to thereby deteriorate toughness. In addition, in the case of 0.40%<C, Ms point becomes too low, the amount of austenite retained is increased and the retained austenite transforms into coarse bainite by tempering, which also leads to deterioration of toughness. Furthermore, in the case of 0.40%<C, weldability deteriorates. In the case of 0.40%<C, there is also a disadvantage that the hardness after annealing increases due to increase of the carbides.

The range of the C content is preferably 0.35%≤C≤0.39%, and more preferably 0.36%≤C≤0.39%.

0.003%≤Si≤0.20%

In the case of Si<0.003%, machinability during machining significantly deteriorates. In addition, it is required to use an expensive raw material with a small content of Si, which leads to an increase in cost.

On the other hand, in the case of 0.20%<Si, the thermal conductivity decreases considerably. In the case of 0.20%<Si, there is also a disadvantage that the hardness after annealing increases due to solid-solution hardening of Si.

The range of the Si content is preferably 0.005%≤Si≤0.18%, more preferably 0.01%≤Si≤0.16%, and further preferably 0.03%≤Si≤0.15%.

Figure 2:
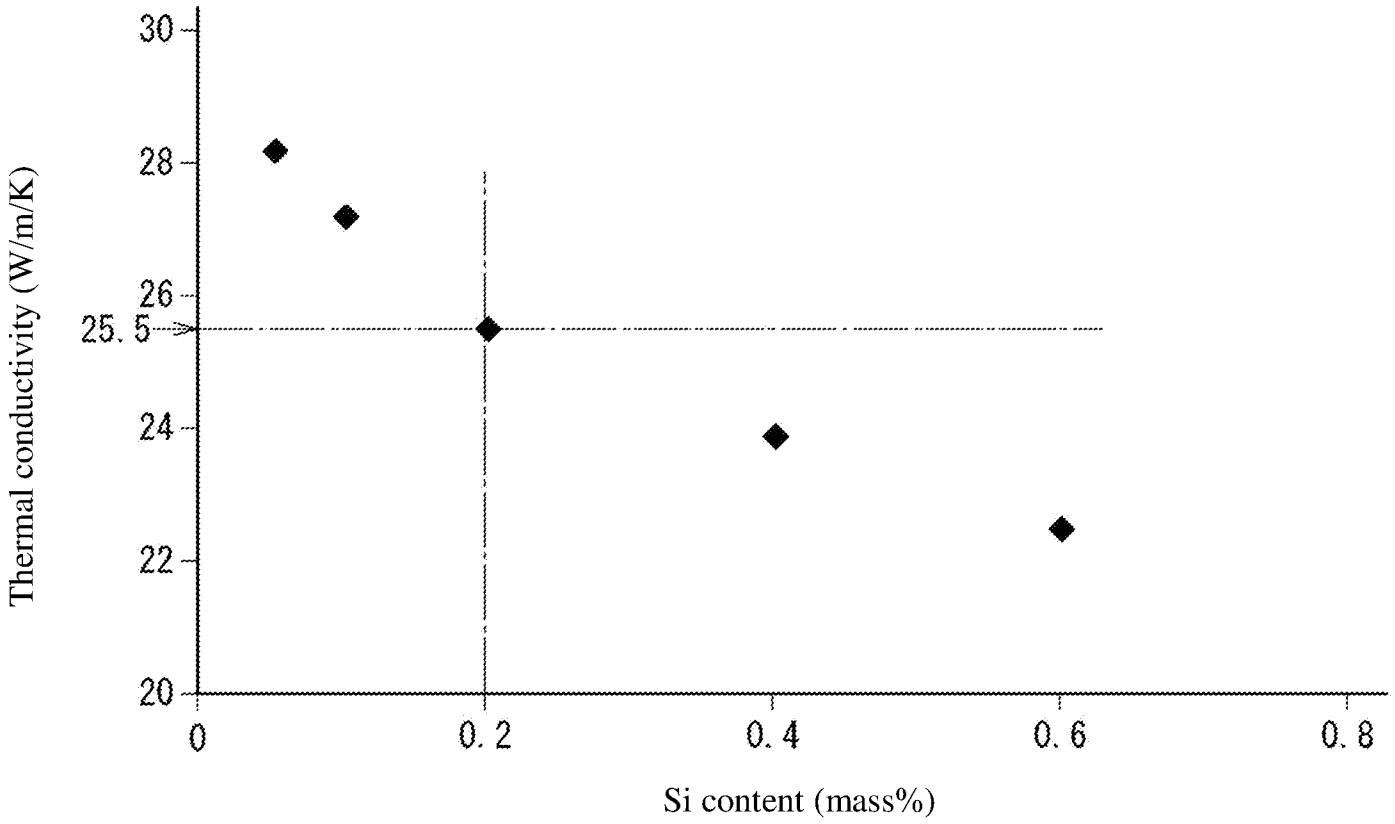
FIG. 2 is a graph showing a relationship between the Si content and thermal conductivity.

FIG. 2 shows a relationship between the Si content and thermal conductivity.

Used steel materials contain 0.40C-0.99Mn-5.99Cr-1.70Mo-0.78V-0.014N as basic components and vary in the content of Si. These steel materials with the above-mentioned components were subjected to an annealing treatment. Test specimens prepared from the annealed materials were heated to 1,030° C., held at 1,030° C. for 5 hours, subsequently cooled from 1,030° C. to 550° C. at a rate of 20° C./min, and cooled from 550° C. to 150° C. at a rate of 3° C./min, to thereby perform quenching. This quenching process simulates the quenching inside a large mold that is difficult to cool. The quenched materials were further tempered to have hardness of 43.3 HRC.

The thermal conductivity at 25° C. of these tempered materials was measured by a laser flash method. The thermal conductivity is preferably as high as 25.5 W/m/K or higher, from the viewpoint of prolonging life of a mold and improving a casting quality. The upper limit of the Si content is set to 0.20% in the present invention since the thermal conductivity is 25.5 W/m/K or higher in the case of Si≤0.20% as shown in FIG. 2. The thermal conductivity of SKD61 subjected to thermal refining under the same condition is as low as about 23.0 W/m/K to 24.5 W/m/K. Accordingly, the steel according to the present invention has thermal conductivity higher than SKD61.

0.72%≤Mn≤0.94%

In the case of Mn<0.72%, hardenability becomes insufficient, which leads to a deterioration in toughness due to incorporation of bainite.

On the other hand, in the case of 0.94%<Mn, the annealing property significantly deteriorates. The deterioration of the annealing property due to such a large content of Mn is particularly significant in the case of a small Cr content, a large Cu content, a large Ni content, and a large Mo content. In addition, in the case of 0.94%<Mn, thermal conductivity also decreases considerably. In the case of 0.94%<Mn, there arises a problem that the impact value after tempering does not increase when the content of Si or P is large.

The range of the Mn content is preferably 0.72%≤Mn≤0.92%, and more preferably 0.73%≤Mn≤0.90%.

Figure 3:
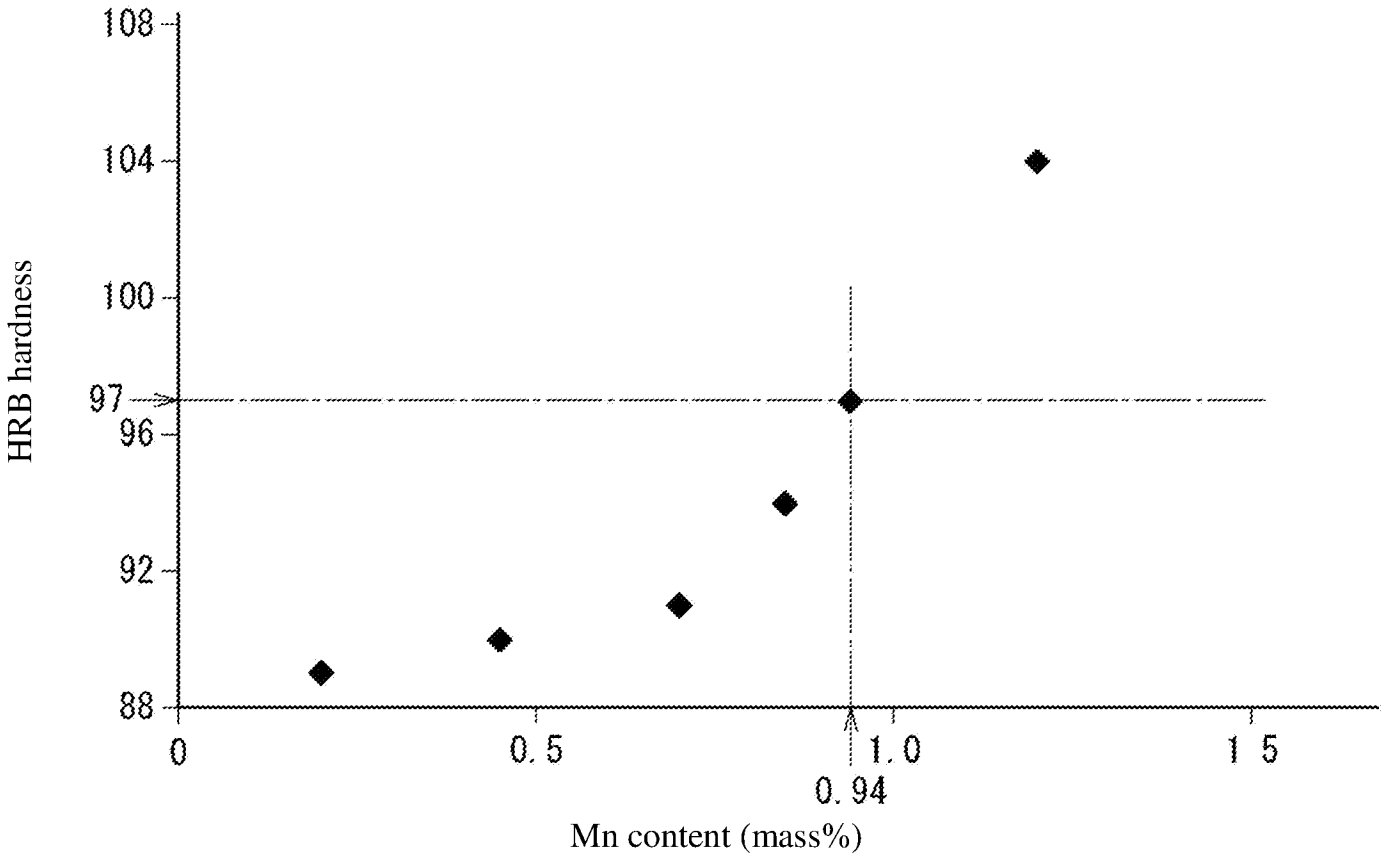
FIG. 3 is a graph showing a relationship between the Mn content and annealing hardness.

FIG. 3 shows a relationship between the Mn content and annealing hardness.

Used steel materials contain 0.38C-0.09Si-5.65Cr-1.97Mo-0.76V-0.026N as basic components and vary in the content of Mn. Test specimens were obtained as follows. The steel materials with the above-mentioned components just after hot-working were used as initial materials, which had significantly coarse crystal grains as initial structures. The initial materials were heated to 680° C. and held at 680° C. for 6 hours. The materials were once cooled to be near room temperature, subsequently reheated to 870° C., held at 870° C. for 2 hours, and then cooled to 600° C. at a rate of 15° C./h.

Annealing hardness is preferably 97 HRB or lower, from the viewpoint of facilitating machining. The upper limit of the Mn content is set to 0.94% in the present invention since the annealing hardness is 97 HRB or lower in the case of Mn≤0.94% as shown in FIG. 3. Annealing hardness of SKD61 subjected to thermal refining under the same condition is about 88 HRB to 94 HRB. The steel according to the present invention has a good annealing property equivalent to SKD61.

5.65%≤Cr≤6.00%

In the case of Cr<5.65%, the quenching property is insufficient. In addition, in the case of Cr<5.65%, corrosion resistance deteriorates, and the mold is prone to crack from inside, starting from rust on a water cooling hole. In the case of Cr<5.65%, the annealing property significantly deteriorates in the case of a large content of Mn. The deterioration of the annealing property is particularly significant in the case of a large Cu content and a large Ni content.

On the other hand, in the case of 6.00%<Cr, the thermal conductivity decreases considerably. In the case of 6.00%<Cr, the softening resistance also deteriorates significantly, and hardness of a surface tends to decrease during usage when the steel of the present invention is used as a mold. The decrease in hardness means a decrease in strength, and the strength required for the mold cannot be ensured. The preferred content range of Cr is 5.67%≤Cr≤5.90%, and more preferably 5.69%≤Cr≤5.88%.

Figure 4:
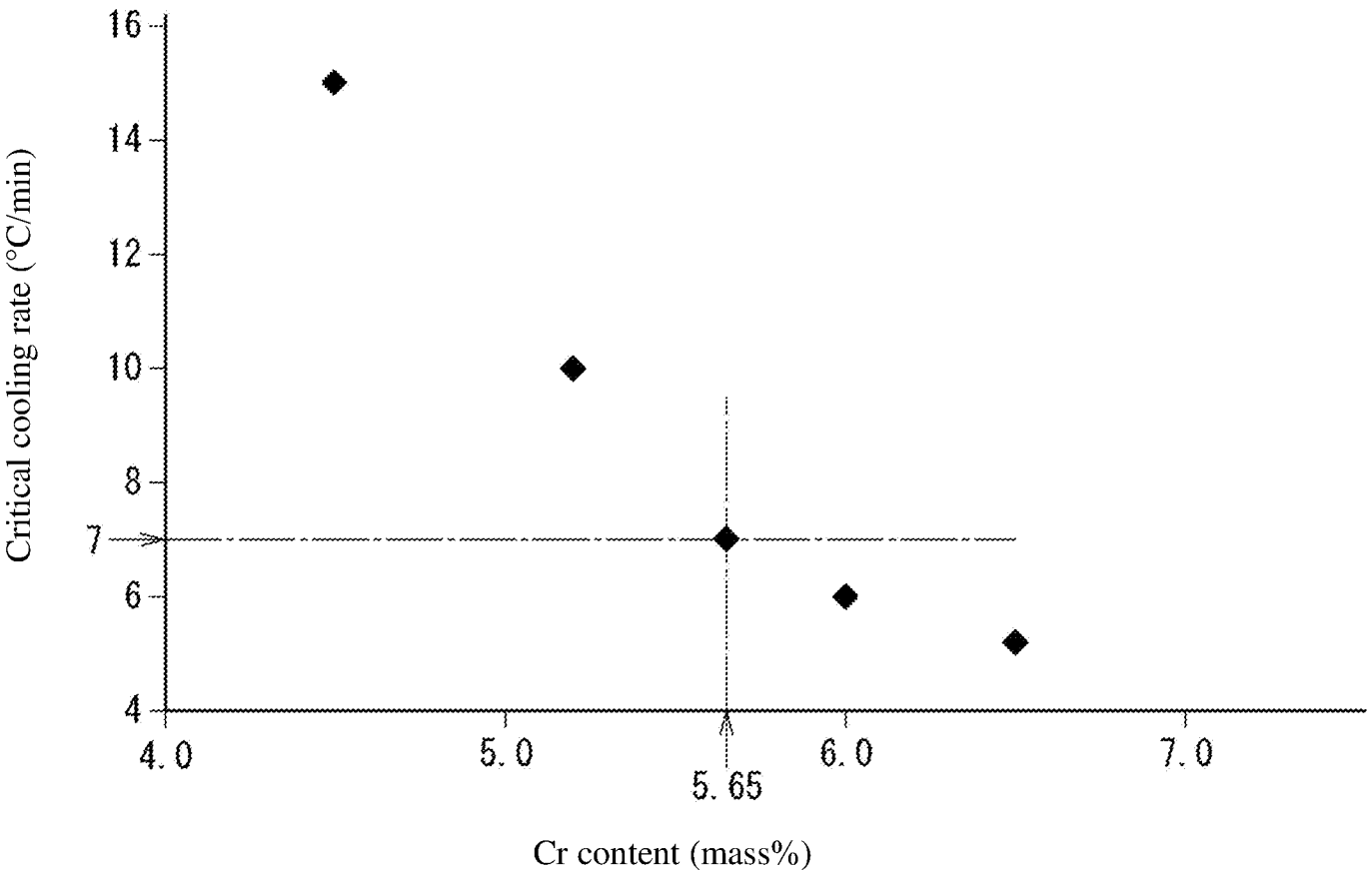
FIG. 4 is a graph showing a relationship between the Cr content and a critical cooling rate.

FIG. 4 shows a relationship between the Cr content and a critical cooling rate.

Used steel materials contain 0.36C-0.09Si—0.73Mn-1.65Mo-0.81V-0.020N as basic components and vary in the content of Cr. The critical cooling rate was determined by an experiment of examining CCT properties. These steel materials with the above-mentioned components were subjected to an annealing treatment. Test specimens prepared from the annealed materials were held at 1,030° C., and then cooled from 1,030° C. to room temperature at a predetermined cooling rate. The critical cooling rate (smallest cooling rate at which martensite single phase is formed) is estimated from such a series of experiments, and plotted with respect to the content of Cr. The critical cooling rate is preferably low since a structure close to the martensite has a high impact value and is difficult to crack. The cooling rate during quenching is reduced to about 3° C./min inside a large mold. However, a considerably high impact value can be ensured even in the case of slow quenching at a rate of 3° C./min, as long as the critical cooling rate of the steel material is 7° C./min or lower. The lower limit of the Cr content is set to 5.65% in the present invention since the critical cooling rate is 7° C./min or lower in the case of 5.65%≤Cr as shown in FIG. 4. The critical cooling rate of SKD61 is about 12° C./min, and the steel according to the present invention has hardenability higher than SKD61.

Figure 5:
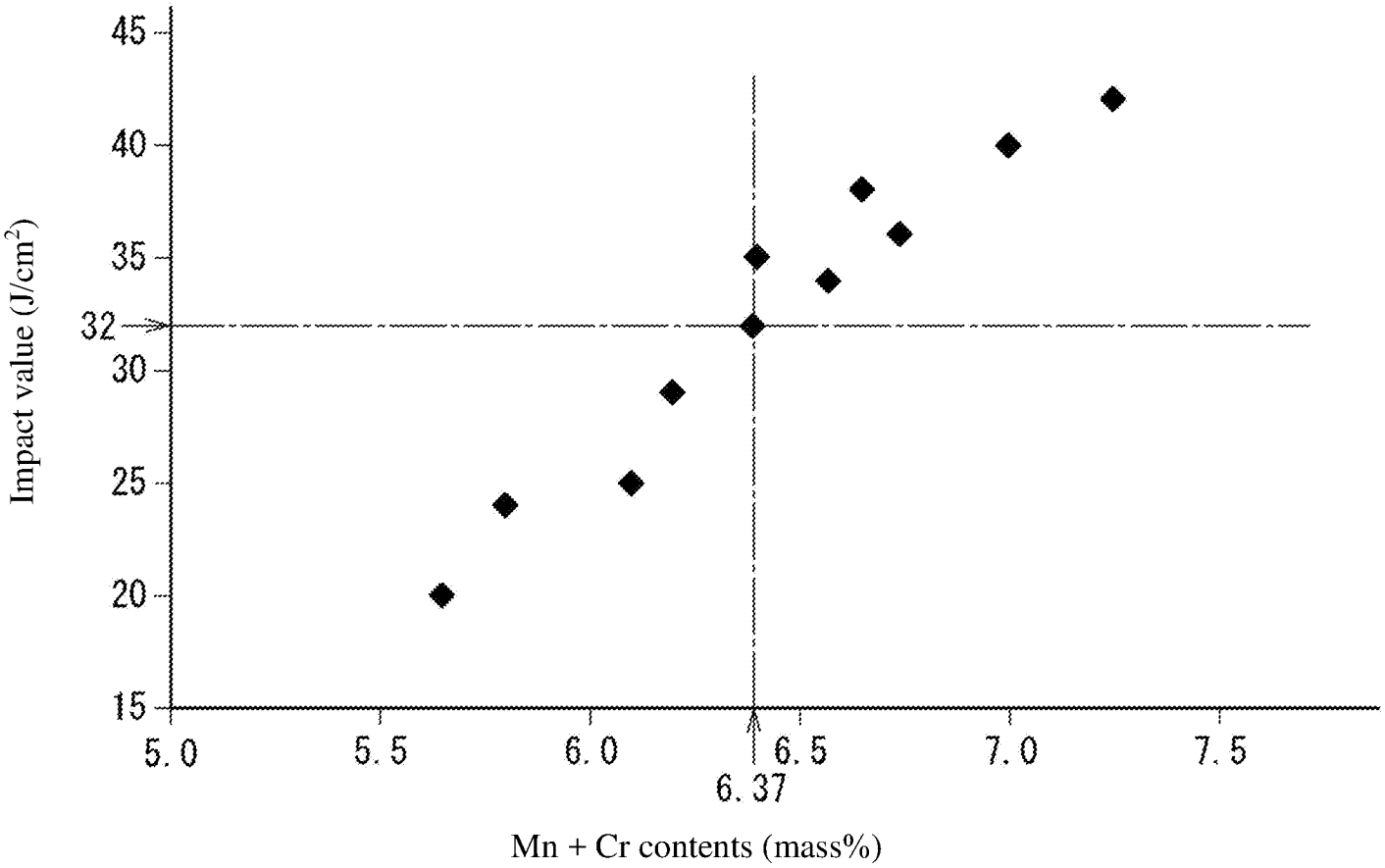
FIG. 5 is a graph showing a relationship between the Mn+Cr contents and an impact value.

FIG. 5 shows a relationship between the content of Mn+Cr and an impact value in a slowly-cooled material.

Used steel materials contain 0.38C-0.08Si-1.68Mo-0.77V-0.020N as basic components, and vary in the content of Mn from 0.45% to 1.2% and in the content of Cr from 5.2% to 6.8%. The steel materials with the above-mentioned components were subjected to an annealing treatment. Test specimens prepared from the annealed materials were heated to 1,030° C., subsequently held at 1,030° C. for 5 hours, cooled from 1,030° C. to 550° C. at a rate of 20° C./min, cooled from 550° C. to 400° C. at a rate of 10° C./min, and cooled from 400° C. to 200° C. at a rate of 3° C./min, to thereby perform quenching. In addition, the quenched materials were tempered to have a hardness of 43±0.5 HRC. The impact value at 25° C. of the tempered materials was evaluated. The mold is difficult to crack in the case where the impact value is 32 J/cm$^2$ or higher. As shown in FIG. 5, in the case where the content of Mn+Cr is 6.37 (0.72Mn+5.65Cr) or higher, the impact value is 32 J/cm2 or higher. That is, in the case where the steel of the present invention is used in a large mold of which inside is slowly cooled, there is little risk of cracking from the inside of the mold even if both the content of Mn and the content of Cr are at the lower limit of the above-described range.

Here, the impact value is calculated by: dividing absorbed energy [J] in an impact test (U notch bottom radius: 1 mm, height under the notch: 8 mm, cross-sectional area under the notch: 0.8 cm$^2$) by the cross-sectional area (0.8 cm$^2$) of the test specimen, and is an average value of the impact values of 10 impact test specimens.

1.65%≤Mo≤2.00%

In the case of Mo<1.65%, it is difficult to stably obtain high hardness of 50 HRC or higher with a large Cr content, small C and V contents, and high tempering temperature. In the case of Mo<1.65%, there is also a disadvantage that high-temperature strength is insufficient.

On the other hand, in the case of 2.00%<Mo, fracture toughness decreases significantly, and cracking of the mold is concerned. In the case of 2.00%<Mo, the material cost also increases significantly.

Due to its large effect on delaying the discharge of carbides from austenite, the addition of Mo deteriorates the annealing property. However, there is a range of the Mo content in which annealing property is improved at a high Mo content. The reasons are based on the two points as follows: as austenite crystal grains are finer, annealing is promoted (the annealing property is good) in which a reaction proceeds from an austenite grain boundary into a grain; and solid-solution Mo has an effect of preventing growth of the austenite crystal grains. The effect of preventing growth of crystal grains is small in the case of Mo<1.65%. On the other hand, in the case of 2.00%<Mo, although the effect of preventing the growth of the crystal grains is further increased, the effect of remarkably delaying the discharge of carbides from austenite is strong, and the annealing property deteriorates. In consideration of such a mechanism, 1.65%≤Mo≤2.00% is a range in which the annealing property can be improved (at least not deteriorate) by adding Mo. A particularly preferred range is 1.67%≤Mo≤1.90%, and still preferably 1.68%≤Mo≤1.89.

Figure 6:
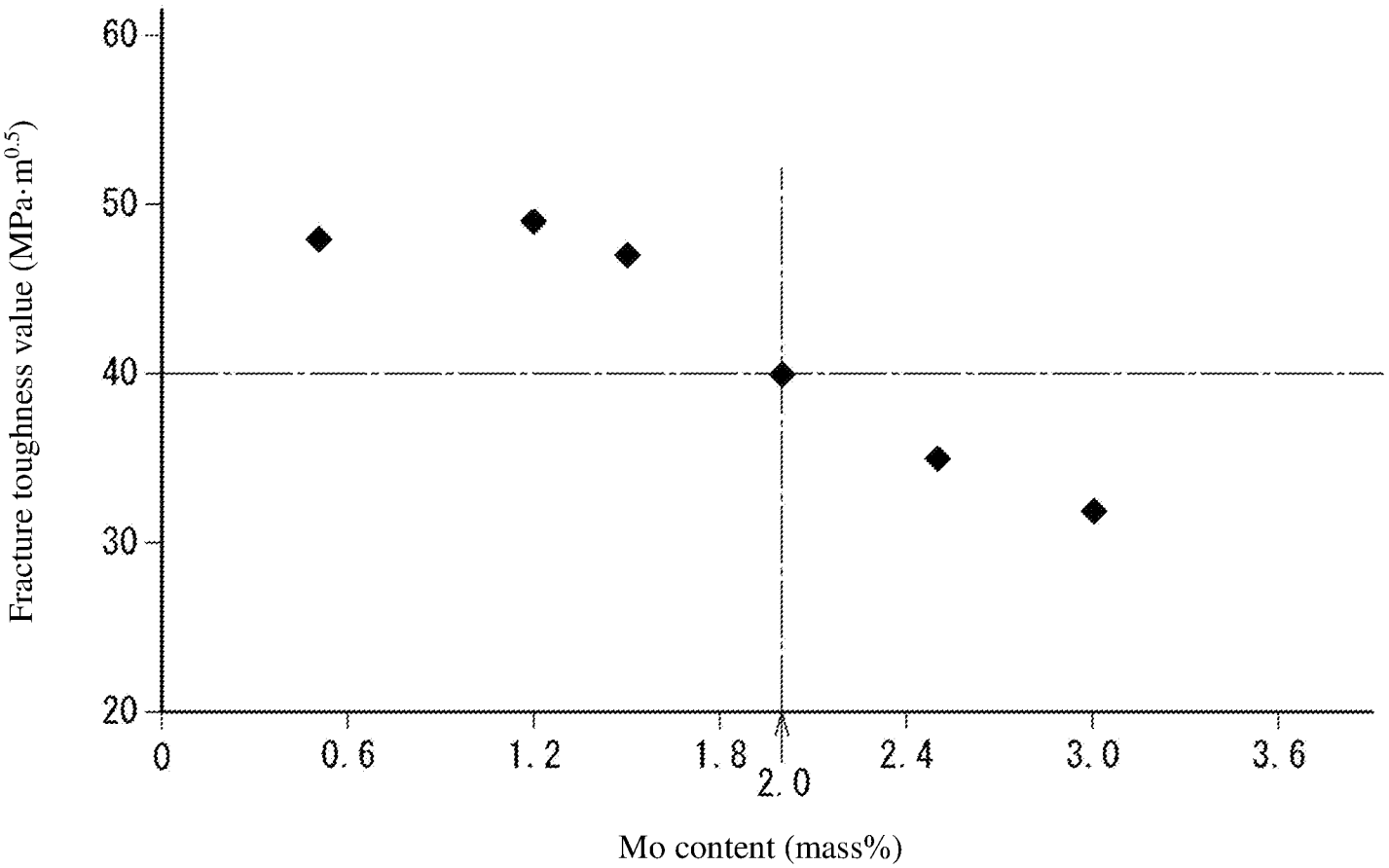
FIG. 6 is a graph showing a relationship between the Mo content and a fracture toughness value.

FIG. 6 shows a relationship between the content of Mo and a fracture toughness value.

Used steel materials contain 0.38C-0.09Si—0.82Mn-5.75Cr-0.78V-0.020N as basic components, and vary in the content of Mo. The test specimens were obtained as follows. The steel materials with the above-mentioned components were subjected to an annealing treatment. The annealed materials were heated to 1,030° C., subsequently held at 1,030° C. for 5 hours, cooled from 1,030° C. to 550° C. at a rate of 20° C./min, cooled from 550° C. to 400° C. at a rate of 10° C./min, and cooled from 400° C. to 200° C. at a rate of 3° C./min, to thereby perform quenching. In addition, the quenched materials were then tempered to have a hardness of 43.3 HRC. The fracture toughness value at 25° C. of the tempered materials was evaluated according to ASTM E 399. The fracture toughness value is preferably as high as 40 MPa·m$^{0.5}$ or higher, from the viewpoint of avoiding cracking of the mold. The upper limit of the Mo content is set to 2.00% in the present invention since the fracture toughness value is 40 MPa·m$^{0.5}$ or higher in the case of Mo≤2.00% as shown in FIG. 6. The fracture toughness value of SKD61 under the same condition is about 38 MPa·m$^{0.5}$, and the steel according to the present invention has a fracture toughness value higher than that of SKD61.

0.71%≤V≤0.90%

In the case of V<0.71%, austenite crystals are likely to be coarsened (crystal grain-size number decreases) because of small amount of VC particles during quenching. This tendency is especially significant in the case where the contents of C, Si and N are small. In the case of V<0.71%, it is difficult to stably obtain high hardness of 50 HRC or higher with a large Cr content, small C and Mo contents, and high tempering temperature.

On the other hand, in the case of 0.90%<V, not only the effect of preventing the growth of austenite crystal grains almost saturates but also the cost increases. Furthermore, the impact value decreases since coarse crystallized carbides (those precipitated during solidification) increase, which serve starting points of cracking. A particularly preferred range is 0.73%≤V≤0.88%, and still preferably 0.73%≤V≤0.87%.

Figure 7:
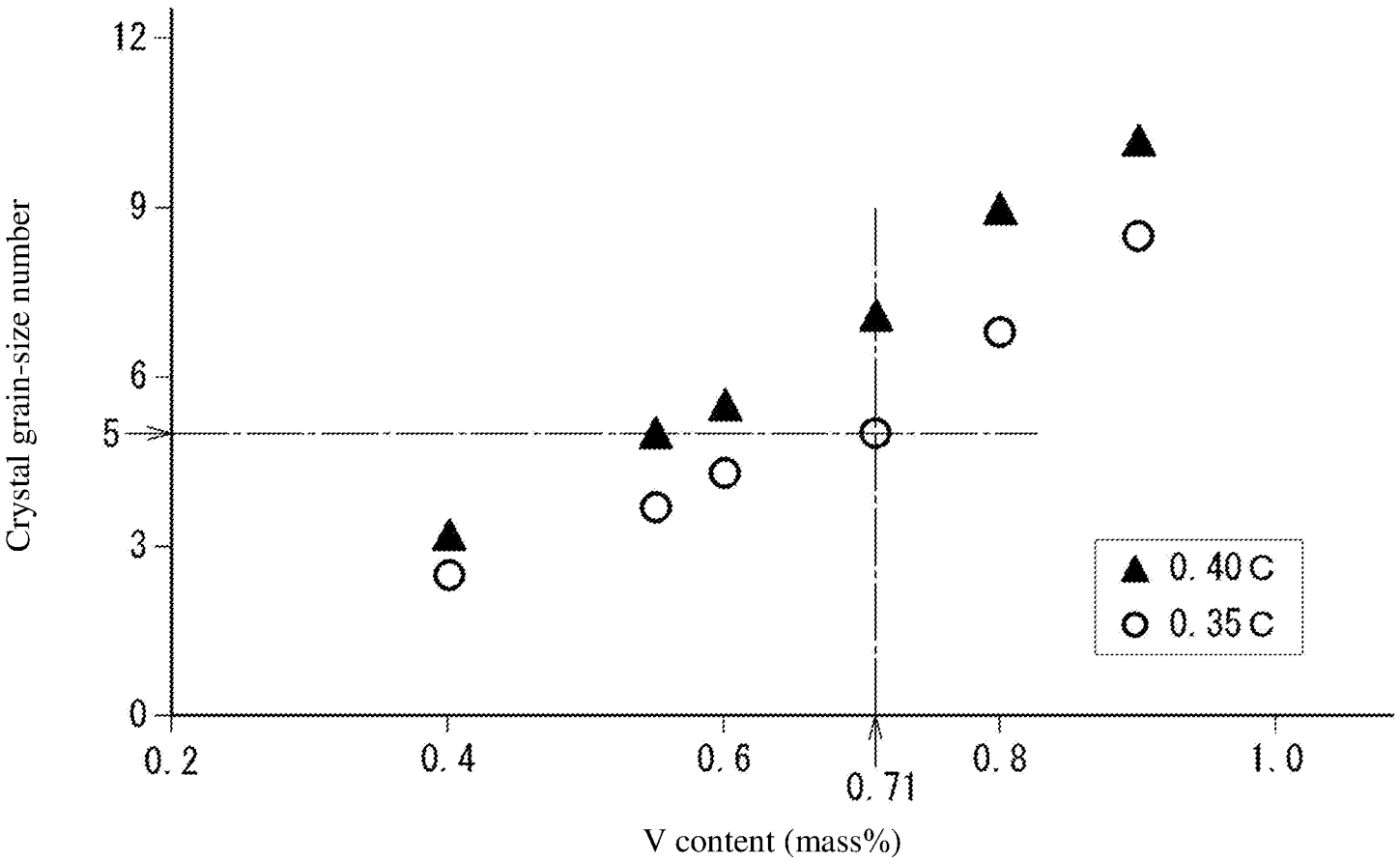
FIG. 7 is a graph showing a relationship between the V content and a grain-size number of austenite crystal grains.

FIG. 7 shows a relationship between the V content and a crystal grain-size number of austenite crystal grains during quenching.

Used steel materials contain 0.13Si-0.81Mn-5.74Cr-1.68Mo-0.020N as basic components, and vary in the content of C in 0.35% or 0.40%, and in the content of V from 0.40% to 0.90%. Test specimens were obtained as follows. The steel materials with the above-mentioned components were subjected to an annealing treatment. The annealed materials were held at 1,030° C. for 5 hours, cooled from 1,030° C. to 550° C. at a rate of 20° C./min, and cooled from 550° C. to 150° C. at a rate of 3° C./min, to thereby perform quenching. The quenched materials obtained as described above were corroded by an acid, to reveal grain boundaries of austenite crystal grains before transformation (referred to as prior-austenite crystal grains), and the crystal grain-size number was evaluated. In the case where the average value of the crystal grain-size number is 5 or greater, the crystal grain in the corroded structure is treated as a "preferred fine crystal grain". As shown in FIG. 7, the crystal grain-size number can be ensured to be 5 or more in the case where the content of V is 0.71% or more even though the content of C is the lower limit of C according to the present invention, that is, 0.35%. Therefore, the lower limit of the V content is set to 0.71% in the present invention.

0.001%≤N≤0.080%

In the case of N<0.001%, austenite crystals are likely to be coarsened (crystal grain-size number decreases) because of small amount of VC particles during quenching. This tendency is especially significant in the case where the contents of C and Si are small.

In the case of 0.080%<N, the time and cost of refining required for adding N increase, leading to an increase in material cost. In addition, in the case of 0.080%<N, the impact value decreases since coarse nitrides or carbonitrides increase, which serve starting points of cracking.

A preferred range of N is 0.003%≤N≤0.070%, which is excellent in balance of various properties, more preferably 0.005%≤N≤0.060%, and further preferably 0.006%≤N≤0.055%.

The steel according to the present invention can achieve a high strength by selectively adding W and/or Co thereto. W increases strength by precipitation of carbides. Co increases the strength by solid solution into a matrix, and simultaneously contributes to precipitation hardening through the change of carbide forms.

In addition, these elements have an effect of preventing the movement of the crystal grain boundaries (coarsening of crystal grains) by dissolving in austenite as a solid-solution during quenching. Specifically, in order to attain these effects, at least one (one element) of the following elements may be incorporated:

0.30%<W≤5.00%, and 0.30%<Co≤4.00%.

Either of the elements exceeding the predetermined content causes saturation of effects, a decrease in thermal conductivity, a significant increase in cost, or the like.

0.30%<Cu≤1.50%

In the case of Cu≤0.30%, the solute drag effect of preventing the movement of a γ grain boundary during quenching is poor, and the effect of preventing coarsening of crystal grains cannot be obtained. In addition, in the case of Cu≤0.30%, the effect of improving the hardenability is also poor, and the effect of increasing hardness by age hardening is also poor. In the case of Cu≤0.30%, the effect of improving machinability is also poor. Therefore, in the case where Cu is contained in order to attain these effects, the content of Cu is set as 0.30%<Cu.

On the other hand, in the case of 1.50%<Cu, cracking during hot-working becomes apparent, the annealing property significantly deteriorates, and thermal conductivity also decreases significantly. In addition, in the case of 1.50%<Cu, the cost increases significantly, and the effect of improving machinability almost saturates. Therefore, the upper limit of Cu is set as Cu≤1.50% in the case where Cu is contained.

The preferred range of Cu is 0.35%≤Cu≤1.35%, which is excellent in balance of various properties, and more preferably 0.40%≤Cu≤1.20%.

0.30%<Ni≤1.50%

In the case of Ni≤0.30%, the effect of avoiding cracking during hot-working in the case of containing a lot of Cu is poor, and the effect of improving the hardenability is also poor. When Al is present, Ni is combined with Al to form an intermetallic compound, thereby increasing strength. In the case of Ni≤0.30%, this effect is poor. Therefore, in the case where Ni is contained in order to attain these effects, the content of Ni is set as 0.30%<Ni.

On the other hand, in the case of 1.50%<Ni, the annealing property deteriorates significantly, and also thermal conductivity decreases significantly. Ni is dissolved in the matrix as a solid-solution after subjected to quenching and tempering. Accordingly, the adverse influence of Ni on the thermal conductivity is large, similar to Si. In the case of 1.50%<Ni, toughness decreases significantly, which is caused by precipitation of the intermetallic compound obtained by combining Ni with Al. Therefore, the upper limit of Ni is set as Ni≤1.50% in the case where Ni is contained.

Addition of B is also effective as a measure of improving the hardenability. Specifically, B is preferably incorporated:

0.0001%<B≤0.0050%.

The effect of improving the hardenability cannot be attained when B forms BN. Accordingly, B is required to be present in the steel alone. Specifically, this can be achieved by forming nitrides with elements having an affinity with N stronger than that with B, thereby preventing B from combining with N. Examples of such elements include Nb, Ta, Ti and Zr. Although these elements have an effect of fixing N even in impurity-level contents, these elements may be added intentionally in the respective ranges defined below, depending on the content of N.

If excessive B is present in a steel alone, the excessive B enhances hardenability, even in the case where B is combined with N in the steel to form BN.

B is also effective to improve the machinability. In the case of improving machinability, BN may be formed. BN has properties similar to those of graphite, so that cutting resistance decreases and chip breakability is improved. Hardenability and machinability are simultaneously improved in the case where B and BN are both present in a steel.

Coarsening of crystal grains become concerned if heating temperature in quenching is increased or heating time in quenching is prolonged due to an unexpected equipment trouble or the like. In preparation for such a case, Nb, Ta, Ti, and/or Zr may be selectively added to prevent the movement of the austenite crystal grain boundary by fine precipitates formed by these elements, to thereby maintain a fine structure. Specifically, at least one (one element) of the following elements is preferably incorporated:

0.004%<Nb≤0.100%,
0.004%<Ta≤0.100%,
0.004%<Ti≤0.100%, and
0.004%<Zr≤0.100%.

Carbide, nitride, or oxide is excessively generated in the case where the content of any of the elements exceeds the predetermined content, which leads to a decrease in toughness.

Similarly, in order to prevent coarsening of austenite crystal grains, Al can be contained in a range of 0.10%<Al≤1.00%. Al has an effect of preventing the movement (that is, grain growth) of the austenite crystal grain boundary by being combined with N to form AlN. Al has a high affinity with N, so that penetration of N into the steel is accelerated. Therefore, the surface hardness tends to be high when the steel containing Al is nitrided. It is effective to use a steel material containing Al for a mold that is subjected to a nitriding treatment in order to obtain higher wear resistance.

However, thermal conductivity and toughness decrease in the case where Al exceeds the predetermined content. The effect described above is exhibited even with Al in impurity-level contents according to the present invention, depending on the content of N.

In order to improve machinability, selective addition of S, Ca, Se, Te, Bi, and/or Pb is also effective. Specifically, at least one (one element) of the following elements is preferably incorporated:

0.0080%<S≤0.0500%,
0.0005%<Ca≤0.2000%,
0.03%<Se≤0.50%,
0.005%<Te≤0.100%,
0.01%<Bi≤0.50%, and
0.03%<Pb≤0.50%.

In the case where any of the elements exceeds the predetermined content, saturation of machinability and deterioration in hot-workability, decreases in impact value and in mirror polishing property are caused.

According to the present invention as described above, it is possible to provide a steel for a mold and a mold using the same, which has a good annealing property, enables generation of fine austenite crystal grains even in a long-time heating in quenching, enables exhibition of a high impact value even in slow-quenching, and has high thermal conductivity.

Examples

Examples and Comparative Examples (total 20 steel grades) shown in Table 2 were tested to evaluate annealing property, crystal grain size, an impact value, and thermal conductivity thereof.

Comparative Example 1 provides a general-purpose hot-working die steel SKD61. Comparative Examples 2 to 5 provide hot-working die steels available in the market as modified steels for SKD61. Comparative Examples 6 and 7 provide steels that have composition similar to those of the present invention than those of Comparative Examples 1 to 5.

In Comparative Examples 1 to 5, four to six elements among the main seven elements of C—Si—Mn—Cr—Mo—V—N are out of the ranges of the present invention. In Comparative Examples 6 and 7, at least one element of Mn—Cr—Mo is out of the ranges of the present invention.

TABLE 2

| | | Chemical Composition (mass %, balance: Fe and inevitable impurities) | | | | | | | |
|---|---|---|---|---|---|---|---|---|---|
| | | C | Si | Mn | Cr | Mo | V | N | Others |
| Examples | 1 | 0.35 | 0.003 | 0.72 | 5.65 | 1.65 | 0.71 | 0.027 | |
| | 2 | 0.40 | 0.20 | 0.94 | 6.00 | 2.00 | 0.90 | 0.080 | |
| | 3 | 0.37 | 0.005 | 0.77 | 5.67 | 1.67 | 0.73 | 0.013 | |
| | 4 | 0.38 | 0.18 | 0.80 | 5.90 | 1.90 | 0.88 | 0.070 | |
| | 5 | 0.39 | 0.01 | 0.87 | 5.71 | 1.68 | 0.75 | 0.005 | |
| | 6 | 0.36 | 0.16 | 0.75 | 5.82 | 1.79 | 0.83 | 0.060 | |
| | 7 | 0.38 | 0.09 | 0.82 | 5.75 | 1.70 | 0.78 | 0.020 | |
| | 8 | 0.35 | 0.05 | 0.78 | 5.86 | 1.88 | 0.84 | 0.003 | 0.61Ni |
| | 9 | 0.38 | 0.12 | 0.81 | 5.78 | 1.85 | 0.77 | 0.001 | 0.58Cu |
| | 10 | 0.36 | 0.14 | 0.79 | 5.74 | 1.69 | 0.87 | 0.024 | 1.26W |
| | 11 | 0.37 | 0.03 | 0.83 | 5.69 | 1.74 | 0.80 | 0.017 | 0.93Co |
| | 12 | 0.39 | 0.10 | 0.73 | 5.80 | 1.78 | 0.78 | 0.009 | 0.03Nb |
| | 13 | 0.40 | 0.08 | 0.90 | 5.73 | 1.82 | 0.75 | 0.034 | 0.0094S |
| Comparative Examples | 1 | 0.38 | 1.02 | 0.44 | 5.19 | 1.19 | 0.92 | 0.018 | |
| | 2 | 0.35 | 0.47 | 0.70 | 5.53 | 1.23 | 0.56 | 0.017 | |
| | 3 | 0.34 | 0.28 | 1.06 | 5.54 | 2.52 | 0.53 | 0.020 | |
| | 4 | 0.34 | 0.40 | 0.60 | 5.03 | 2.89 | 0.60 | 0.014 | |
| | 5 | 0.36 | 0.20 | 0.46 | 4.88 | 2.46 | 0.54 | 0.013 | |
| | 6 | 0.35 | 0.09 | 0.58 | 4.83 | 1.68 | 0.71 | 0.007 | |
| | 7 | 0.35 | 0.04 | 0.94 | 5.65 | 3.31 | 0.88 | 0.012 | |

These 20 steel grades shown in Table 2 were respectively cast into ingots, each of which had a weight of 50 kg, to produce steel ingots. The steel ingot was subjected to homogenization treatment at 1,250° C. for 24 hours, and then the steel ingot was formed into a bar shape of 45 mm×60 mm×2,000 mm, which had a rectangular cross-section, by hot-working. The steel bar was softened by tempering at 750° C. for six hours. Four types of test specimens (annealing property, crystal grain size, impact value, thermal conductivity) were prepared from the steel bar.

Test specimens, for which the annealing property and the crystal grain size were evaluated, were small blocks of 12 mm×12 mm×20 mm, respectively. The test specimen, for which the impact value was evaluated, was a small square bar of 11 mm×11 mm×55 mm (subsequently finished as an impact test specimen by fine processing). The test specimen, for which the thermal conductivity was evaluated, was a small cylinder of a diameter of 15 mm×length of 55 mm (subsequently finished as a thermal conductivity test specimen by fine processing).

Evaluation of Annealing Property:

The test specimen, which was a small block of 12 mm×12 mm×20 mm, was treated in an annealing condition at producing a die-casting mold material, and whether to soften the test specimen was examined First, in order to reproduce coarse crystal grains in hot-working, the small block was held at 1,240° C. for two hours and then cooled to room temperature. Subsequently, the small block was held at 670° C. for eight hours, then heated to 870° C., held at 870° C. for two hours, and then cooled from 870° C. to 600° C. at a rate of 15° C./h, and then allowed to stand cooling, thereby performing an annealing on the small block. These heat treatments were based on conditions used in the process of manufacturing a material for a die-casting mold. After that, the HRB hardness of the test specimen (annealed material) was measured. In the case of 97 HRB or lower, the annealing property was good and determined as "A" (pass); whereas in the case of exceeding 97 HRB, the annealing property was poor and determined as "C" (fail).

The results are shown in Table 3. The actual HRB hardnesses measured are also shown in parentheses together with the evaluations as "A" or "C" in the table.

The steels of Comparative Examples 3 and 7 were evaluated as "C" (fail). The reason for the poor annealing property of the steel in Comparative Example 3 is that the Mn content was as large as about 1.1%. Mn improves the hardenability, but significantly impairs the annealing property, which is an adverse effect. On the other hand, the reason for the poor annealing property of the steel in Comparative Example 7 is that the Mn content was as large as about 0.9%, and the Mo content was excessively large, which slowed the aggregation of carbides.

Evaluation of Crystal Grain Size:

The test specimen, which was a small block of 12 mm×12 mm×20 mm, was treated in a heating condition at quenching the die-casting mold, and the crystal grain size was examined Specifically, the test specimen was heated to 1,030° C., held at 1,030° C. for five hours, cooled from 1,030° C. to thereby perform quenching. During the heating for quenching a large mold, slow-heating and long-term holding are performed in order to sufficiently and homogeneously heat the inside of the mold heated slowly. As a result, the mold surface, which is heated rapidly, is held at a high temperature for a very long time. Steels for such a die-casting mold are required to have a crystal grain-size number to be 5 or higher (crystal grains are fine) even under such severe conditions. In the actual manufacturing process of a mold, the time for holding the steel at the quenching temperature of 1,030° C. may extend to five hours in some cases. Accordingly, in the test, the time for holding at 1,030° C. was set to five hours, and then, assuming a mold surface, the surface of the test specimen was cooled to 550° C. at a rate of 50° C./min, cooled from 550° C. to 400° C. at a rate of 25° C./min, and cooled from 400° C. to 200° C. at a rate of 10° C./min.

The surface of the test specimen (quenched material) was mirror-polished and corroded by an acid to make an austenite crystal grain boundary at heating for quenching (a state of being held at 1,030° C. for five hours) appear. The structure of the austenite crystal grain boundary was observed by a microscope, and the crystal grain-size number of the prior-austenite crystal grain was evaluated according to JIS G0551.

The crystal grain-size number to be evaluated was an average value of the crystal grain-size numbers obtained in three visual fields. In the case where the grain size number was five or more, the prior-austenite crystal grain was determined as fine grains and "A" (pass); whereas in the case where the grain size number was less than five, the prior-austenite crystal grain was determined as coarse grains and "C" (fail).

The results are shown in Table 3. The actual crystal grain-size numbers measured are also shown in parentheses together with the evaluations of "A" or "C" in the table. The steels in Comparative Examples 2, 3, 4 and 5 were evaluated as "C" (fail).

These failed steels had a low V content. Therefore, the amount of VC particles (particles that were dispersed during quenching to prevent growth of the austenite crystal grain boundary) was also small, and crystal grains were likely to grow.

Evaluation of Impact Value:

The small square bar of 11 mm×11 mm×55 mm was subjected to a quenching process for a large die-casting mold, and the impact value thereof was evaluated. Specifically, the small square bar was held at 1,030° C. for five hours, cooled from 1,030° C. to 550° C. at a rate of 20° C./min, cooled from 550° C. to 400° C. at a rate of 10° C./min, and further cooled from 400° C. to 200° C. at a rate of 3° C./min During cooling in the quenching for a large mold, the inside of the mold is cooled slowly. The cooling process in the quenching process of this test corresponds to a process in which a large die-casting mold of 250 kg to 2,000 kg was quenched with blast or high-temperature oil. It is required to have a high impact value even in such a slow quenching (slow-rate quenching).

The quenched small square bar was thermally refined to have a hardness of 43±0.5 HRC by a plurality of tempering at 600° C. to 620° C., and processed into an impact test specimen of 10 mm×10 mm×55 mm (U notch bottom radius: 1 mm, height under the notch: 8 mm, cross-sectional area under the notch: 0.8 $cm^2$). An impact value means a value obtained by dividing the absorbed energy [J] in an impact test by the cross-sectional area (0.8 $cm^2$) of the test specimen. The impact value was evaluated by the average value of 10 specimens. In the case where the test specimen has the impact value of 32 $J/cm^2$ or greater, the steel is difficult to crack when being used as a mold. Accordingly, in the case where the impact value was 32 $J/cm^2$ or greater in average, the impact value was determined as high and "A" (pass); whereas in the case where the impact value was less than 32 $J/cm^2$, the impact value was determined as low and "C" (fail).

The results are shown in Table 3. The actual impact values (unit: $J/cm^2$) measured are also shown in parentheses together with the evaluations as "A" or "C" in the table.

The steels in Comparative Examples 1, 2, 4, 5, and 6 were evaluated as "C" (fail). The steels in Comparative Examples 2, 4, and 5 had a small crystal grain-size number as shown in Table 3, and thus cracks were likely to grow. As a result, the impact values decreased. In particular, the steel in Comparative Example 5 had the low Mn content and low Cr content, and further had low hardenability, leading to such a significant reduction in the impact value. The steels in Comparative Examples 1 and 6 had low hardenability though they had a sufficiently large crystal grain number of 5 or greater (crystal grains were fine). Therefore, the structures of the steels in Comparative Examples 1 and 6 formed coarse bainite, and the impact value decreased. The steels in Comparative Examples 3 and 7 were evaluated as "A" (pass) among Comparative Examples. The steel in Comparative Example 3 had the small crystal grain-size number, but had a very high hardenability due to its large Mn content of 1.06% (1.1Mn). Therefore, the steel in Comparative Example 3 had a fine structure close to martensite, leading to the high impact value. The steel in Comparative Example 7 was evaluated as "A" (pass), but had the low impact value due to its excessively large Mo content. As shown in FIG. 6, excessive addition of Mo is not preferred from the viewpoint of fracture toughness, and also has a disadvantage of significantly increasing the material cost.

Evaluation of Thermal Conductivity:

The small cylinder of a diameter of 15 mm×length of 55 mm was subjected to the same quenching and tempering processes as the impact test specimen, and was thermally refined to have a hardness of 43±0.5 HRC. Then, from the small cylinder was prepared a test specimen of a diameter of 10 mm×length of 2 mm for measuring thermal conductivity. The thermal conductivity of the test specimen at 25° C. was measured by a laser flash method. From the viewpoint of prolonging the life of the mold and improving the casting quality, the thermal conductivity is preferably higher. In the case where the thermal conductivity was 25.5 W/m/K or higher, the thermal conductivity was determined as high and "A" (pass); whereas in the case where the thermal conductivity was less than 25.5 W/m/K, the thermal conductivity was determined as low and "C" (fail).

The results are shown in Table 3. The actual thermal conductivities (unit: W/m/K) measured are also shown in parentheses together with the evaluations of "A" or "C" in the table.

The steels in Comparative Examples 1 and 2 were evaluated as "C" (fail). The steel in Comparative Example 1 had the very high Si content of 1.02%, which leads to a particularly low thermal conductivity. The steel in Comparative Example 2 was close to "A" (pass), but the thermal conductivity could not be sufficiently increased since the Si content was high. The steel in Comparative Example 4 had the relatively high Si content of 0.40% but had the low Cr content, thereby ensuring a high thermal conductivity. Furthermore, the steel in Comparative Example 5 having the low Cr content and low Si content had a very high thermal conductivity.

TABLE 3

| | | Annealing Property | Crystal Grain Size | Impact Value | Thermal Conductivity |
|---|---|---|---|---|---|
| Examples | 1 | A (86) | A (5.4) | A (53) | A (31.9) |
| | 2 | A (89) | A (10.2) | A (57) | A (26.2) |
| | 3 | A (87) | A (7.7) | A (53) | A (31.2) |
| | 4 | A (87) | A (9.8) | A (54) | A (27.7) |
| | 5 | A (86) | A (8.0) | A (56) | A (30.3) |
| | 6 | A (87) | A (8.4) | A (55) | A (28.8) |
| | 7 | A (86) | A (9.2) | A (54) | A (29.5) |
| | 8 | A (86) | A (9.6) | A (56) | A (30.9) |
| | 9 | A (88) | A (8.2) | A (55) | A (28.9) |
| | 10 | A (88) | A (9.7) | A (54) | A (29.1) |
| | 11 | A (86) | A (9.1) | A (56) | A (31.0) |
| | 12 | A (87) | A (9.2) | A (55) | A (29.3) |
| | 13 | A (87) | A (8.9) | A (55) | A (29.0) |
| Comparative Examples | 1 | A (89) | A (10.1) | C (21) | C (23.5) |
| | 2 | A (87) | C (4.7) | C (29) | C (25.4) |
| | 3 | C (107) | C (4.5) | A (42) | A (26.8) |
| | 4 | A (92) | C (4.8) | C (22) | A (27.7) |
| | 5 | A (96) | C (4.3) | C (19) | A (31.0) |
| | 6 | A (93) | A (6.3) | C (22) | A (31.2) |
| | 7 | C (102) | A (7.9) | A (33) | A (28.1) |

The followings can be understood from the evaluation results of the four items shown in Table 3.

The steels in Comparative Examples 1 to 5, which are conventional steels, are problematic in at least two items.

The steel in Comparative Example 6, which has a Mn content and a Cr content lower than the respective lower limits of the present invention, is problematic in the item of impact value.

The steel in Comparative Example 7, which has a Mo content higher than the upper limit of the present invention, is problematic in the item of annealing property.

In contrast, the steels in the Examples 1 to 13 are not problematic in any of the items. In the case of the steel materials of the Examples, materials for a mold can be rapidly provided at a low cost due to the good annealing property of the steel materials. In addition, the steels of the Examples can generate fine austenite crystal grains even when the steels are heated in quenching for a long time, and can attain a high impact value even in slow-rate quenching. Therefore, cracking in a large mold can be satisfactorily prevented. Furthermore, a mold having high thermal conductivity can be obtained, so that it can be expected that shortening of the casting cycle and high quality of the cast product can be achieved.

Although Examples according to the present invention are described above in detail, these are mere examples. For example, it is also effective to use the steel according to the present invention by applying shot peening, nitriding treatment, PVD treatment, CVD treatment, plating treatment, and other surface modification treatments to the steel. Furthermore, the steel according to the present invention can be applied to powders and plates used for mold formation by an additive manufacturing of powders and plates, and can be used as a rod for welding repair of a main body or a component of a die. As such, various modifications can be made without departing from the scope of the present invention The present application is based on Japanese Patent Application No. 2018-071149 filed on Apr. 2, 2018, and the contents thereof are incorporated herein by reference.

What is claimed is:

1. A steel for a mold, having a composition consisting of, on % by mass basis:

0.35%≤C≤0.40%;
0.003%≤Si≤0.12%;
0.72%≤Mn≤0.94%;
5.65%≤Cr≤6.00%;
1.65%≤Mo≤2.00%;
0.71%≤V≤0.90%;
0.017%≤N≤0.080%;
W≤5.00%;
Co≤4.00%;
Cu≤1.50%;
B≤0.0050%;
Nb≤0.100%;
Ta≤0,100%;
Ti≤0.100%;
Zr≤0.100%;
Al≤1.00%;
S≤0.0500%;
Ca≤0.2000%;
Se≤0.50%;
Te≤0.100%;
Bi≤0.50%; and
Pb≤0.50%, with a balance being Fe and inevitable impurities, wherein the steel has a crystal grain-size number of 5 or higher when the steel is heated to 1,030° C., held at 1,030° C. for five hours, and cooled from 1,030° C. for quenching, wherein the steel has a thermal conductivity of 25.5 W/m/K or higher, and wherein the steel has an impact value of 53 J/cm$^2$ or more when the steel is held at 1,030° C. for five hours, cooled from 1,030° C. to 550° C. at a rate of 20° C./min, cooled from 550° C. to 400° C. at a rate of 10° C./min, and further cooled from 400° C. to 200° C. at a rate of 3° C./min.

2. The steel for a mold, according to claim 1, wherein, on % by mass basis, at least one of following conditions is satisfied:

0.30%<W≤5.00%, and
0.30%<Co≤4.00%.

3. The steel for a mold, according to claim 1, wherein, on % by mass basis, 030%<Cu≤1.50%.

4. The steel for a mold, according to claim 1, wherein, on % by mass basis:

0.0001%<B≤0.0050%.

5. The steel for a mold, according to claim 1, wherein, on % by mass basis, at least one of following conditions is satisfied:

0.004%<Nb≤0.100%,
0.004%<Ta≤0.100%,
0.004%<Ti≤0.100%, and
0.004%<Zr≤0.100%.

6. The steel for a mold, according to claim 1, wherein, on % by mass basis:

0.10%<Al≤1.00%.

7. The steel for a mold, according to claim 1, wherein, on % by mass basis, at least one of following conditions is satisfied:

0.0080%<S≤0.0500%,
0.0005%<Ca≤0.2000%,
0.03%<Se≤0.50%,
0.005%<Te≤0.100%,
0.01%<Bi≤0.50%, and
0.03%<Pb≤0.50%.

8. A mold, formed of the steel for a mold, described in claim 1.

9. The steel for a mold, according to claim 1, wherein, on % by mass basis:

0.36%≤C≤0.39%.

10. The steel for a mold, according to claim 9, wherein, on % by mass basis:

0.73%≤Mn≤0.90%.

11. The steel for a mold, according to claim 10, wherein, on by mass basis:

5.69%≤Cr≤5.88%.

12. The steel for a mold, according to claim 11, wherein, on % by mass basis:

1.68%≤Mo≤1.89%.

13. The steel for a mold, according to claim 12, wherein, on % by mass basis:

0.73%≤V≤0.87%.

14. The steel for a mold, according to claim 1, wherein, on % by mass basis;

0.005%<Te≤0.100%.

15. The steel for a mold, according to claim 14, wherein, on % by mass basis:

0.01%<Bi≤0.50%.

16. The steel for a mold, according to claim 15, wherein, on % by mass basis:

0.03%<Pb≤0.50%.

17. The steel for a mold, according to claim 1, wherein, on % by mass basis, at least one of following conditions is satisfied:

0.01%<Bi≤0.50%; and
0.03%<Pb≤0.50%.

18. The steel for a mold, according to claim 1, wherein the steel has a crystal grain-size number of 7.7 or more.

19. The steel for a mold, according to claim 1, wherein Mn+Cr≥6.37%.

20. A steel, having a composition consisting of, on % by mass basis:

0.35%≤C≤0.40%;
0.003%≤Si≤0.12%;
0.72%≤Mn≤0,94%;
5.65%≤Cr≤6.00%;
1.65≤Mo≤2.00%;
0.71%≤V≤0.90%;
0.017%≤N≤0.080%; and
at least one element selected from a group consisting of:
Cu≤1.50%;
W≤5.00%;
Co≤4.00%;
Nb≤0.100%; and
S≤0.0500%,
with a balance being Fe and inevitable impurities,
wherein the steel has a crystal grain-size number of 5 or higher when the steel is heated to 1,030° C., held at 1,030° C. for five hours, and cooled from 1,030° C. for quenching,
wherein the steel has a thermal conductivity of 25.5 W/m/K or higher, and
wherein the steel has an impact value of 53 J/cm$^2$ or more when the steel is held, at 1,030° C. for five hours cooled from 1,030° C. to 550° C. at a rate of 20° C./min, cooled from 550° C. to 400° C. at a rate of 10° C./min, and further cooled from 400° C. to 200° C. at a rate of 3° C./min.

21. The steel according to claim 20, wherein the steel has a crystal grain-size number of 7.7 or more.

22. The steel according to claim 20, wherein Mn+Cr≥6.37%.

23. A steel, having a composition consisting of, % by mass basis:

0.35%≤C≤0.40%;
0.003%≤Si≤0.12%;
0.72%≤Mn≤0.94%;
5.65%≤Cr≤6.00%;
1.65%≤Mo≤2.00%;
0.71%≤V≤0.90%; and
0.017%≤N≤0.080%,
with a balance being Fe and inevitable impurities,
wherein the steel has a crystal grain-size number of 5 or higher when the steel is heated to 1,030° C., held at 1,030° C. for five hours, and cooled from 1,030° C. for quenching,
wherein the steel has a thermal conductivity of 25.5 W/m/K or higher, and
wherein the steel has an impact value of 53 J/cm$^2$ or more when the steel is held at 1,030° C. for five hours, cooled from 1,030° C. to 550° C. at a rate of 20° C./min cooled from 550° C. to 400° C. at a rate of 10° C./min, and further cooled from 400° C. to 200° C. at a rate of 3° C./min.

24. The steel according to claim 23, wherein the steel has a crystal grain-size number of 7.7 or more.

25. The steel according to claim 23, wherein Mn+Cr≥6.37%.

* * * * *